United States Patent [19]

Arnold

[11] Patent Number: 4,579,284

[45] Date of Patent: Apr. 1, 1986

[54] SPRAY HEAD FOR GENERATING A PULSATING SPRAY

[75] Inventor: Don C. Arnold, Buffalo Grove, Ill.

[73] Assignee: Beatrice Companies, Inc., Chicago, Ill.

[21] Appl. No.: 601,489

[22] Filed: Apr. 18, 1984

[51] Int. Cl.[4] ..... B05B 3/04; B05B 3/16

[52] U.S. Cl. ..... 239/381

[58] Field of Search ..... 239/102, 380–383, 239/460, 99

[56] References Cited

U.S. PATENT DOCUMENTS

| | | | |
|---|---|---|---|
| 4,141,502 | 2/1979 | Grohe | 239/381 |
| 4,190,207 | 2/1980 | Fierhold et al. | 239/381 |
| 4,203,550 | 5/1980 | On | 239/383 |
| 4,324,364 | 4/1982 | Buzzi et al. | 239/383 |

FOREIGN PATENT DOCUMENTS

| | | | |
|---|---|---|---|
| 975441 | 11/1964 | United Kingdom | 239/381 |

*Primary Examiner*—Andres Kashnikow
*Assistant Examiner*—Mary Beth O. Jones
*Attorney, Agent, or Firm*—Cook, Wetzel & Egan, Ltd.

[57] ABSTRACT

A spray head is disclosed which is capable of generating a pulsating spray and is particularly suited for domestic shower and bath use. The spray head employs a rotor which, as it is turned by flowing water, axially reciprocates to alternately open and restrict a water flow passageway through the spray head. Means are also provided for adjusting the spray head to provide a continuous spray with the rotor continuing to rotate, thus reducing the risk of rotor clogging or freezing.

21 Claims, 16 Drawing Figures

SPRAY HEAD FOR GENERATING A PULSATING SPRAY

The present invention relates, in general, to spray heads suitable for domestic shower and bath use. More particularly, the present invention relates to such spray heads which provide a pulsating spray.

Domestic shower heads capable of generating a pulsating spray have been commercially available for many years. Such shower heads, however, have typically had a number of drawbacks, which are usually related to the relatively complicated structure used for generating the pulsating spray. These drawbacks have limited the utility and success of prior shower heads.

In the past, for example, pulsating spray heads which permitted the selection of a pulsating spray or a continuous spray often employed two separate chambers or flow paths for the flow of water, one chamber or flow path being used for pulsating spray and other chamber or flow path being used for continuous spray. The flow path for generating a pulsating spray often involves an oscillating or rotating member. Because flow in a normal spray condition is directed through a different channel, the oscillating member does not function in that operating mode, and is thus susceptible to clogging or freezing from sediment or mineral build up. Additionally, because of the necessary bulk or size of spray head with two separate chambers or flow paths, its feasibility and popularity in hand-held applications, an increasingly popular alternative to wall-mounted shower units, is limited. The complexity of such shower heads also results in relatively high cost.

Yet another drawback of many pulsating spray heads in the past is that they have generally provided a fine pulsating spray, with each individual stream of the spray being pulsed, rather than pulsation of the stream as a whole. This can result in a stinging needle-like spray which is considered by many to be less desirable than a pulsating of the whole spray, which provides a more gentle massage-type action.

Accordingly, it is a general object of the present invention to provide a spray head suitable for domestic shower and bath use which is capable of generating a pulsating spray, and which does not suffer from the deficiencies described above.

It is another object of the present invention to provide such a spray head, the construction of which is not unduly complicated and may be manufactured at relatively low cost.

It is a further object of the present invention to provide such a spray head which has improved resistance to clogging from sediment or mineral deposits.

It is yet another object of the present invention to provide such a spray head which is particularly suited in size and weight for use in a hand-held spray unit.

These and other objects are met by the present invention which is embodied in a spray head having a housing and a flow path through the housing, one end of the flow path being adapted for attachment to a water supply, and the other end of the flow path terminating in a spray discharge. In accordance with the present invention, a rotor is freely rotatably mounted within the housing and includes means, such as vanes, for causing rotation of the rotor as water flows through the flow path. As the rotor rotates, it is caused to reciprocate axially by means, such as a cam-follower arrangement, and alternately opens and restricts the flow path as it reciprocates, to create a pulsating flow. Preferably all of the water flows through the flow path controlled by the rotor, so that the entire shower spray, rather than individual streams, is pulsed simultaneously.

In accordance with a further aspect of the present invention, means are provided for adjusting the spray from pulsating to continuous, while permitting the rotor to continue to rotate, thereby reducing the risk of the rotor clogging or freezing by mineral deposits or sediment. In the preferred embodiment, this is achieved by a simple user adjustment which causes separation of the cam and the follower. Although the rotor continues to rotate, the reciprocal movement ceases, and the spray becomes continuous.

Because of the relatively few parts required for a spray head of the present invention, it may be made at relatively low cost and in a very compact size which is particularly well suited for use in a hand-held spray unit, although it is equally well suited as a wall-mounted shower head.

These and other aspects and advantages of the present invention are set forth in the following detailed description of the preferred embodiment of the present invention depicted in the attached drawings, of which:

Figure 1:
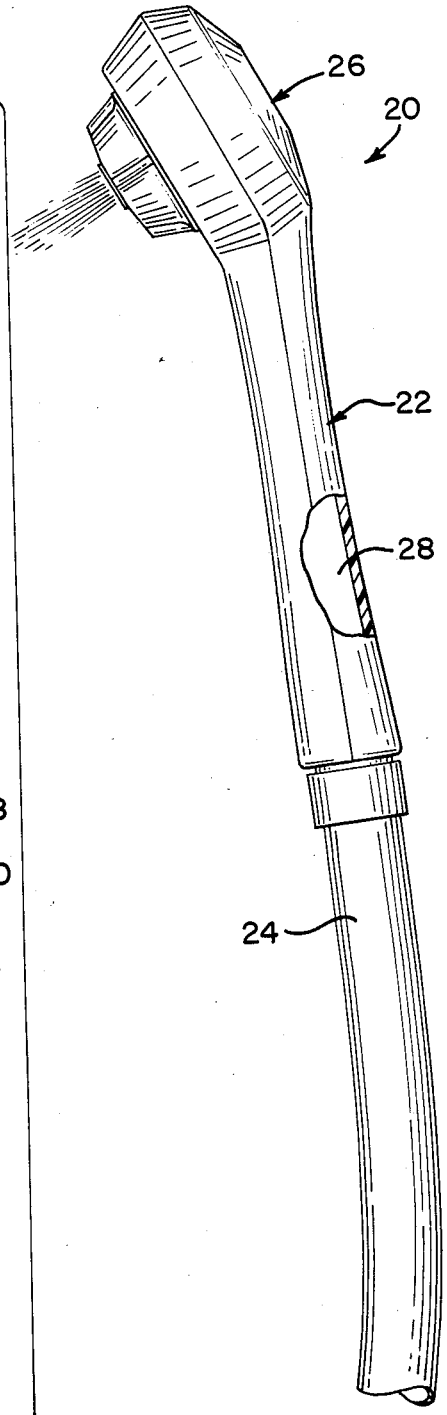
FIG. 1 is a side elevational view of a hand-held spray unit embodying the present invention.

In summary, the present invention is generally embodied in a spray head of the type suitable for use in domestic showers and baths, either as a wall-mounted spray unit or as a hand-held unit such as depicted in FIG. 1. The hand-held unit shown in FIG. 1 is generally identified by the number 20. It includes an elongated handle portion 22, which is attached to a flexible hose 24, and a spray head portion 26 from which the spray is emitted. The hose 24 is attached to a water supply (not shown), and water flows through a passageway 28 in the handle to the spray head 26.

Figure 2:
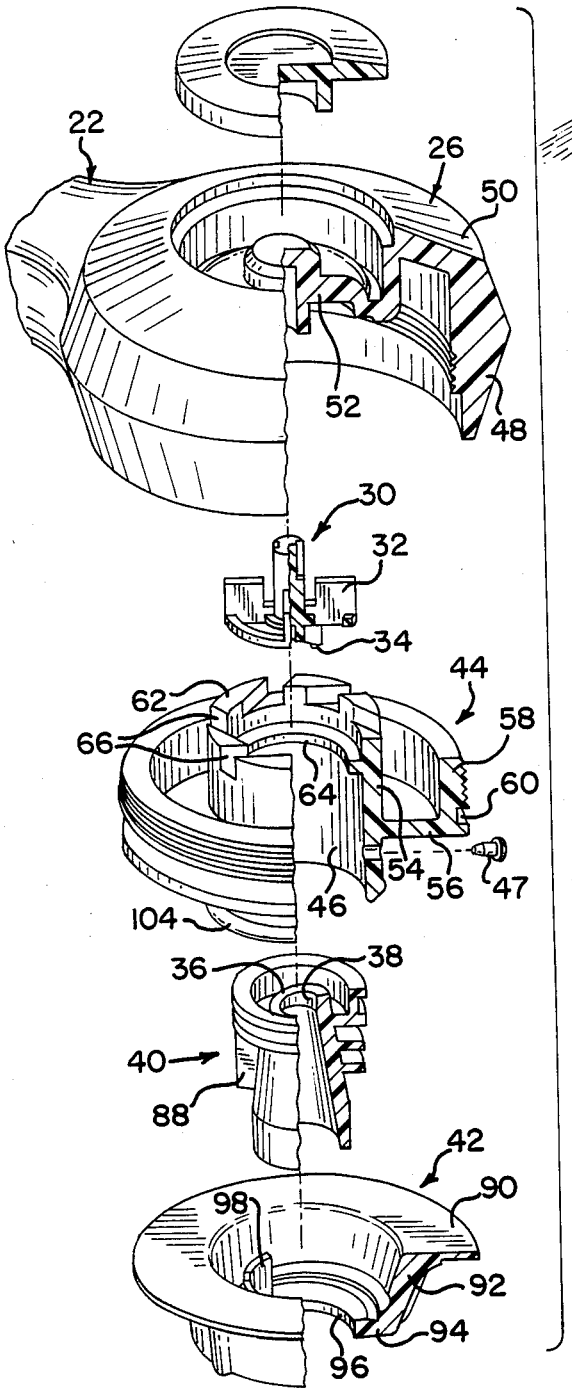
FIG. 2 is an exploded perspective view, partially in section, of the spray head portion of the hand-held unit of FIG. 1.
Figure 3:
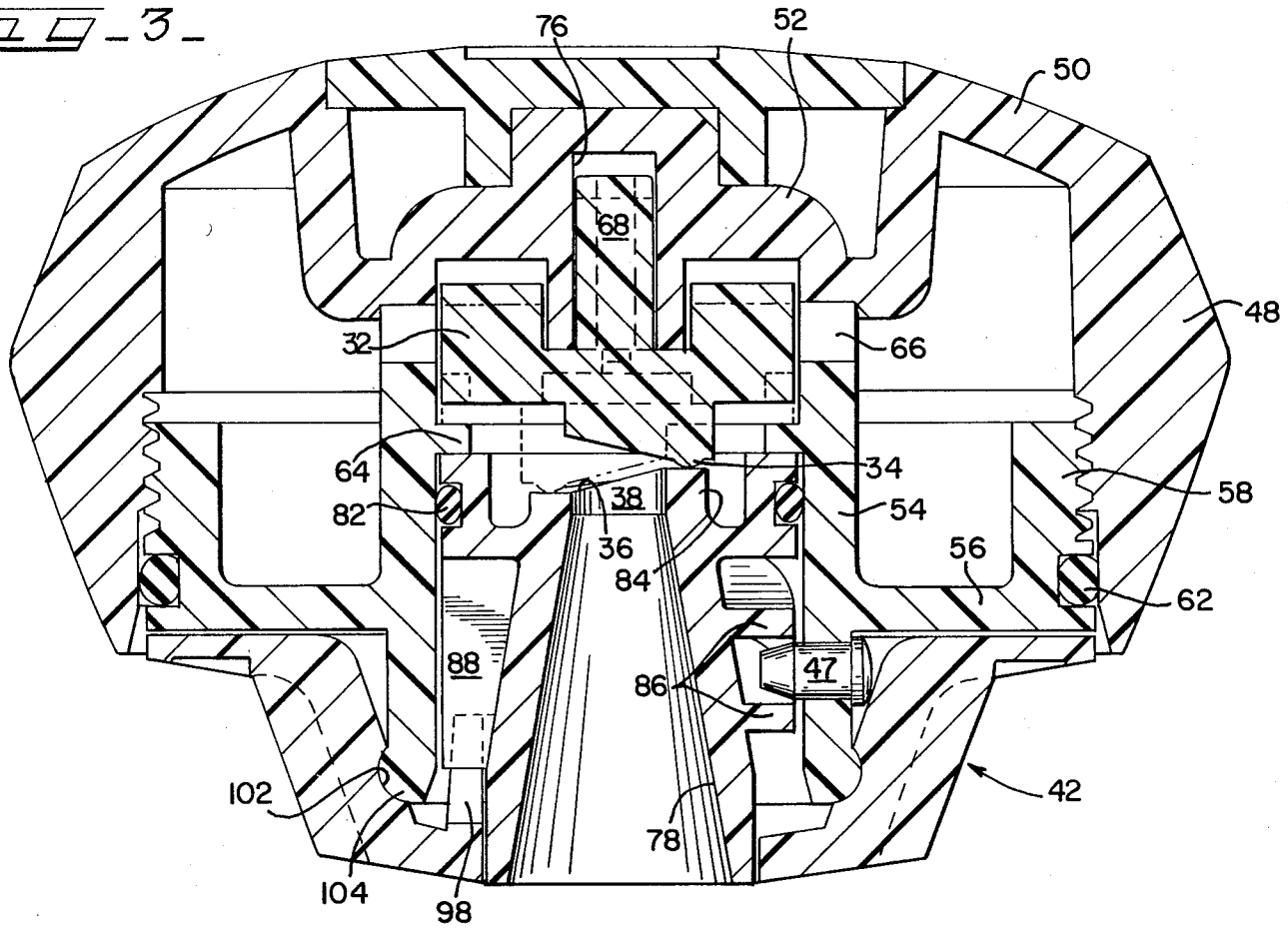
FIG. 3 is a vertical cross-sectional view of the assembled spray head of FIG. 2, with the spray head adjusted to provide a pulsating flow.
Figure 4:
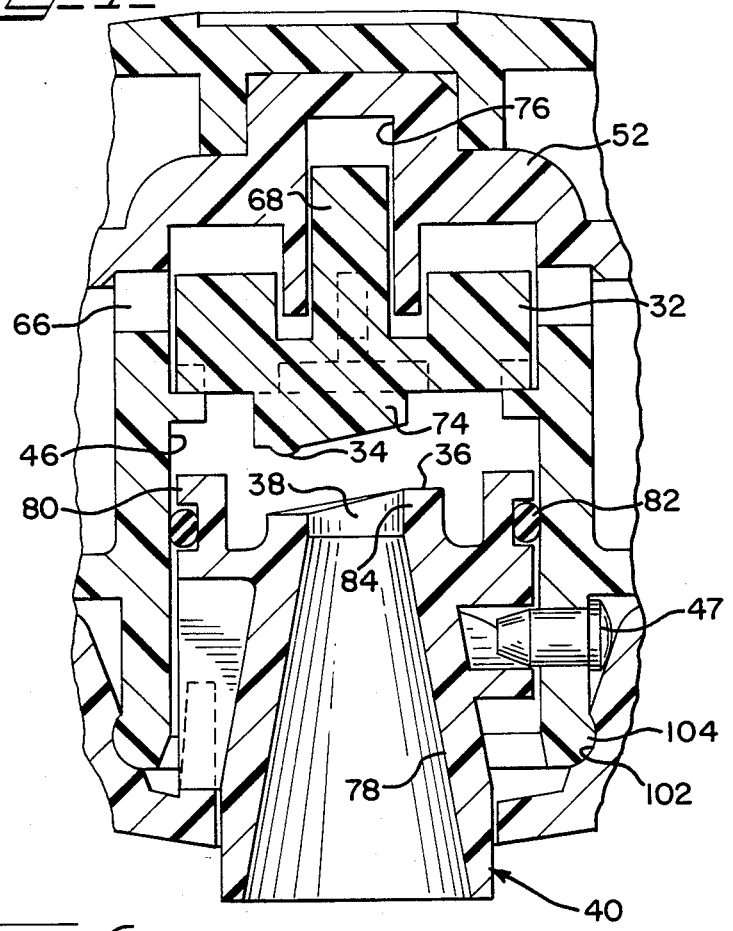
FIG. 4 is a partial vertical sectional view of the spray head, similar to that in FIG. 3, but with the spray head adjusted to provide a continuous spray.

In accordance with the present invention, and referring to FIGS. 2–4, a rotor 30 is freely rotatably mounted within the spray head. The rotor includes means, such as vanes 32, which cause to rotor to spin as water flows through the spray head. The rotor is also cooperatively associated with other means, such as follower 34 and ramp-shaped cam track 36, although other means may also be employed, which cause the rotor to reciprocate axially as it rotates. The rotor is mounted in close association with a water passageway through the spray head, such as the inlet 38 to spray nozzle 40, so that it alternately opens and restricts the passageway, creating a pulsating spray as it reciprocates.

In the preferred embodiment of the present invention, the follower 34 is mounted on the rotor 30, and the cam track 36 is located at the inlet end of the spray nozzle 40. The particular cam-follower arrangment may be varied, and the follower and cam track need not be part of the rotor and nozzle respectively, without departing from the present invention. To change the spray in the illustrated embodiment, the nozzle 40 is axially movable between a position where the cam track and follower are continuously in contact, as depicted in FIG. 3, which provides a pulsating spray, and a position, as shown in FIG. 4, where the nozzle is spaced from the rotor and a substantially continuous spray is provided. It should be noted that regardless of the nozzle position, the rotor will continue to spin as water flows through the housing, thereby reducing the chances of clogging or freezing from mineral deposits or sediment.

While various means may be provided to move the nozzle axially, in the preferred embodiment, the nozzle is threadedly engaged with the housing. Movement of the nozzle is effected by rotating face plate 42, which is directly accessible to the user, and is rotationally fixed to the nozzle.

Turning now to a more detailed description of the preferred spray head depicted in the attached drawings, FIG. 2 is an exploded perspective view of the various parts, excluding O-ring seals, employed in the hand held spray unit 20. In brief, the spray unit 20 includes an outer housing formed by the handle 22 and spray head 26. An insert member 44 is threadedly secured within the spray head and has a generally cylindrical bore 46 which contains the rotor 30 and the nozzle 40. Face plate 42 is carried by the end of the insert 44 and rotatably fixed to the nozzle. A pin 47 extends through the sidewall of bore 46 and threadedly engages the nozzel 40 so that axial movement of the nozzle (and cam track 36) may be effected by rotation of the face plate.

The handle 22 and spray head 26 are preferably of one-piece, injection molded plastic construction, although other materials or methods of manufacture may be used without departing from the present invention. The material should, however, be of sufficient strength to withstand typical domestic water pressure, which is usually less than about 75 psi. The spray head houses the various parts introduced above. Referring to FIGS. 2 and 3, the spray head is generally hollow, with a cylindrical sidewall 48, which is internally threaded, and a top wall 50. A center portion 52 of the top wall is recessed below the remainder of the top wall for cooperation with the insert member 44 and the rotor 30.

The insert member 44 is also of one-piece, rigid plastic construction. As shown in FIGS. 2 and 3, the insert member 44 has a generally cylindrical wall 54 which defines the center bore 46. For mounting the insert 44 within the spray head, a flange 56 extends radially outwardly from the cylindrical wall 54 intermediate the ends and terminates in an outer ring 58 threaded for attachment to the interior of sidewall 48 of the spray head 26. The outer ring also includes an annular groove 60 adjacent to the threads for receiving an elastomeric O-ring 62 which assures a liquid tight seal between outer ring of the insert and the sidewall 48 of the spray head.

The cylindrical wall 54 of the insert is of sufficient length that when attached to spray head 26, the inner end 62 of cylindrical wall abuts the inside surface of the spray head top wall, and captures the rotor 30 in a chamber defined between the top wall and internal annular rib 64 provided in the center bore 46. To permit water to enter the chamber, a plurality of tanential passageways 66 through the cylindrical wall are located at the inner end thereof. The tangential passageways provide a swirling, vortex generating flow in the chamber, which causes the rotor to turn and also breaks the water up into a spray.

Figure 6:
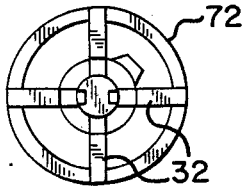
FIG. 6 is a top plan view of the rotor of FIG. 5.
Figure 7:
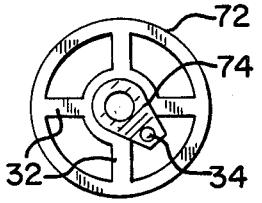
FIG. 7 is a bottom plan view of the rotor of FIG. 5.
Figure 5:
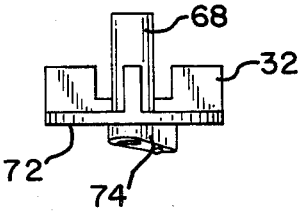
FIG. 5 is a vertical plan view of a rotor employed in the preferred embodiment of the present invention, as depicted in FIGS. 2–4, for providing a pulsating spray.
Figure 8:
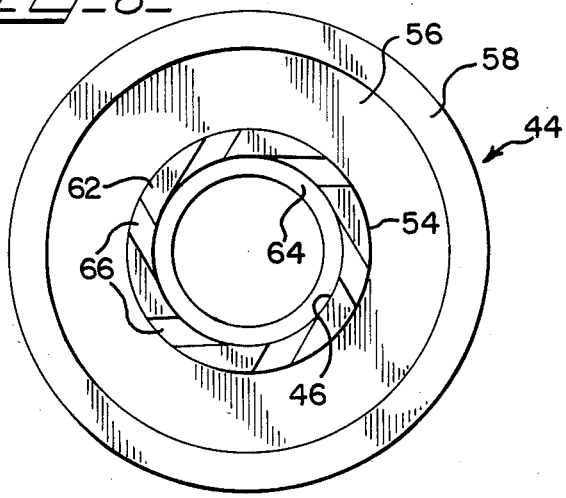
FIG. 8 is a top plan view of an insert member employed in the preferred embodiment of the present invention depicted in FIGS. 2–4.
Figure 9:
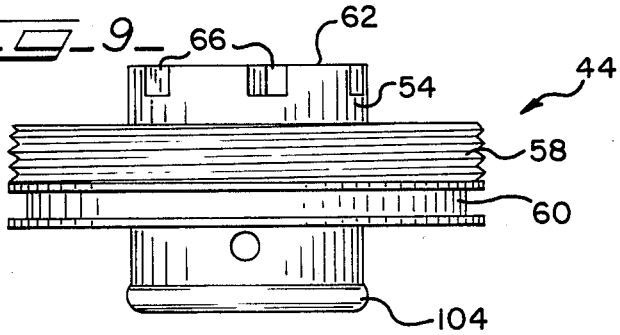
FIG. 9 is a side elevation view of the insert member of FIG. 8.
Figure 10:
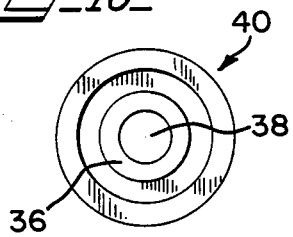
FIG. 10 is a top view of a nozzle employed in the shower head of the present invention depicted in FIGS. 2–4.
Figure 11:
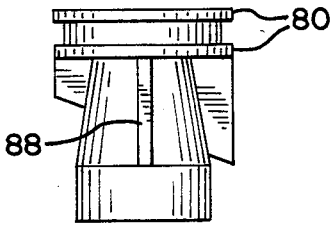
FIG. 11 is a side elevational view of the nozzle of FIG. 10.
Figure 12:
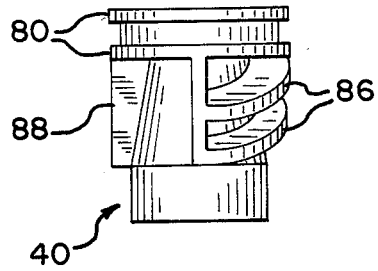
FIG. 12 is another side view of the nozzle of FIG. 10, rotated 90° from the position depicted in FIG. 11.
Figure 13:
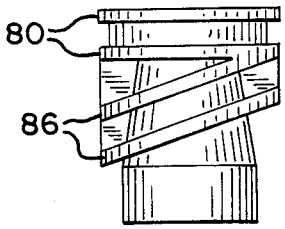
FIG. 13 is a side elevational view of the nozzle of FIG. 10, rotated 180° from the position shown in FIG. 11.

The rotor 30 which causes the pulsating spray is more fully shown in FIGS. 5–7. Preferably the rotor is of one-piece rigid, injection molded plastic, although other materials may also be used. More particularly, the rotor 30 has a center pin or stud 68 and plurality of vanes 32 which extend radially outwardly from the pin 68. The number and particular shape of the vanes may be varied, depending on the direction and velocity of water flowing past the rotor. In the preferred embodiment, where water enters the chamber in which the rotor is located from a radial direction through the side wall (cylindrical wall 54), there are four vanes spaced 90° apart, each vane having a generally flat, radially directed panel. A continuous outer ring 72 connects the vanes and provides a continuous surface which engages against internal rib 64 of the insert when the nozzle 40 is in the continuous spray position shown in FIG. 4.

For axial reciprocation, the rotor 30 further includes a generally radially directed depending member 74 on the underside thereof. The member 74 defines the follower 34 in the form of an axially offset dimple, which is positioned to engage against the cam track 36 provided at the inlet end of the nozzle 40.

As shown in FIG. 3, and noted above, the rotor is located within center bore 46 of the insert member 44 and between the inside surface of topwall portion 52 of the spray head and the internal rib 64 of the insert member. An extension of rotor pin 68 extends upwardly into a cylindrical bore 76 in the top wall portion 50 of the spray head. The pin 68 is sufficiently long that a substantial portion of it extends into bore 76 even when the rotor 30 rests against rib 76. Rotation of the rotor is caused by water entering the tangential passageways 66 formed in the upper end of the cylindrical wall 54 and engaging the vanes 32 of the rotor.

FIGS. 3, 4, and 10–13 depict the spray nozzle 40 employed in the preferred embodiment of the present invention. It also is preferably injection molded of rigid plastic material, although it may be manufactured using other material or employing other techniques without departing from the present invention.

Referring momentarily back to the cross-sectional views of FIGS. 3 and 4, the nozzle 40 has a generally diverging tapered interior surface 78 which diverges substantially linearly from the inlet orifice 38 of the nozzle. The tapered nozzle, which may also include portions diverging at different angles, as described more fully in U.S. Pat. No. 4,497,444, forms the spray into a generally uniformly dense spray.

The upper end of the nozzle includes a pair of radially extending flanges 80 which are axially spaced to define a groove for receiving an elastomeric O-ring 82. The flanges are sized so that the nozzle may be inserted into the center cylindrical bore 46 of the insert 44, with the O-ring 82 providing a liquid-tight seal between the interior surface of the bore and the nozzle.

A short axial extension 84 at the inlet end of the nozzle, defines the generally ramp-shaped cam track 36, which is engaged by the follower 34 on the rotor 30. As best seen in FIGS. 2, 3 and 4, the cam track 36 is circular and ramp-shaped, to raise and lower the rotor 30 once during each rotation of the rotor. For example, when the rotor is in the position shown in solid lines in FIG. 3, the angle of the better surface depending radial member 74 extends upwardly, substantially opening the nozzle inlet 38 to the flow of water. When the rotor rotates 180° from that position, to the lowest position on the ramp (as shown in dashed lines in FIG. 3) the inlet to the nozzle is substantially restricted, although not totally closed.

Returning to FIGS. 11–13, for adjusting the axial position of the nozzle 40 within bore 46, a pair of ribs or walls 86 extend generally diagonally along the outer surface of the nozzle to form a thread or groove segment which extends around approximately 180° of the nozzle. This permits axial movement of the nozzle (and cam track) relative to the rotor by rotation of the nozzle. As noted earlier, the metal pin 47 extends through cylindrical wall 54 and into the thread or groove segment to cause axial movement of the nozzle as the nozzle is rotated. For user adjustment of the nozzle position, the nozzle includes a generally radial tab or wall segment 88, which cooperates with the face plate 42 to allow user adjustment of the nozzle.

Figure 14:
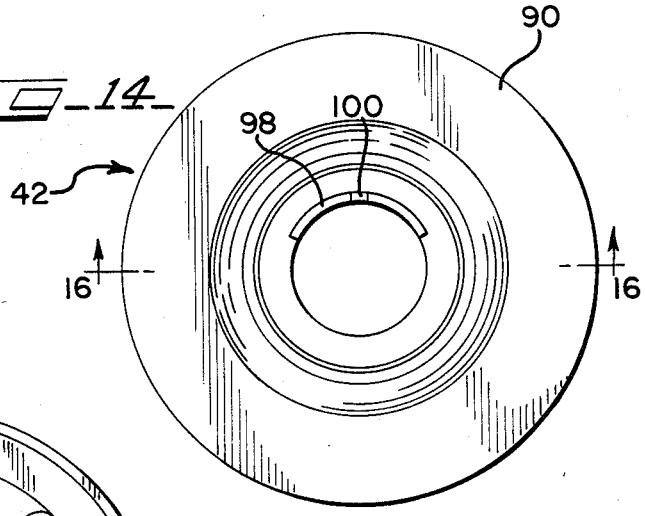
FIG. 14 is a top, interior view of a face plate employed in the spray head of the present invention for adjusting the type of spray provided.
Figure 15:
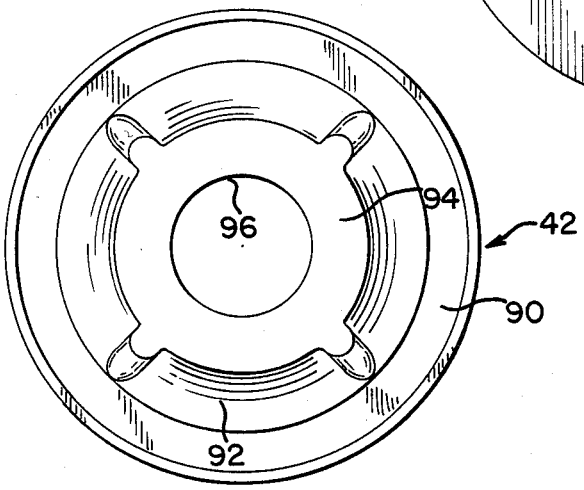
FIG. 15 is a bottom plan view of the face plate of FIG. 14.
Figure 16:
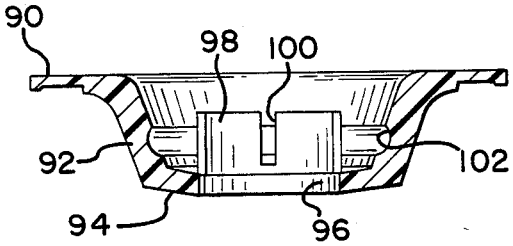
FIG. 16 is a cross-sectional view of the face plate taken along line 16—16 of FIG. 14.

The face plate is depicted by itself in FIGS. 14–16. In general, the face plate is also of plastic construction, preferably injection molded of a rigid plastic material, and may be of a different color than the spray head 26 to highlight it to the user. Referring to FIG. 16, the face plate is generally dish-shaped with a radial upper rim portion 90, a tapered side wall 92, and a bottom wall 94. A center opening 96 is provided in the bottom wall through which the end of the nozzle 40 extends. As shown in FIG. 15, a plurality of raised gripping ribs are provided on the external surface of the side wall 92 to permit user rotation of the face plate, for nozzle adjustment.

To effect rotation of the nozzle, the face plate has an internal arcuate wall portion 98 with a slot 100 for receiving the tab 88 of the nozzle. The face plate is rotationally attached to the end of the insert member. A recessed annular groove 102 on the interior of the face plate provides a snap lock engagement with the bulbous surface 104 at the end of the insert.

In operation, the spray head of the present invention provides an infinite variety of spray conditions from essentially fully pulsating to substantially continuous. Because the rotor is always rotating, regardless of the spray selected, it is less susceptible to clogging or freezing from lime deposits or sediment than prior shower heads. Moreover, the plastic construction of essentially all of the parts of the present invention, except pin 47, provide for relatively low cost manufacture and assembly.

When a user desires a pulsating spray, the face plate is rotated clockwise, which rotates the nozzle clockwise and moves the nozzle, via the threaded engagement with pin 47, to a position closely adjacent to the rotor as depicted in FIG. 3. In that position, the rotor is lifted above the interior rib 64 on the insert, and the follower 34 and cam track 36 are in substantially continuous engagement. Water from a supply (not shown) flows upwardly through the handle, into the annular space in the spray head 26 defined between the cylindrical wall of the insert member the side wall 48 of the spray head. The water then flows through the tangential passageways 66 defined in the insert wall, and into the chamber in which the rotor 30 is located. The swirling action of the water caused by the tangential passageways, engages the rotor vanes 32 and causes the rotor to spin. As the rotor spins, engagement between the cam follower and cam track cause the rotor to axially reciprocate one full cycle for each revolution. The center pin or stud 64 of the rotor, which extends upwardly into bore 70 of the top wall, is sufficiently long to hold the rotor in an axially aligned position despite the axial reciprocation of the rotor. As the rotor turns, the depending member 74 alternately open (FIG. 3, solid lines) and restricts (FIG. 3, dashed lines) the inlet 38 of nozzle 40, creating a pulsating spray.

In accordance with one advantage of the present invention, the swirling, vortex generating action of water creates a low-pressure area in the vicinity of the nozzle inlet 38. This vacuum serves to hold the rotor follower 34 in close engagement with the cam track 36 throughout each rotation of the nozzle and thus provide the desired pulasting spray.

When the user desires a spray that is not a full pulsating spray, or is completely continuous, he or she rotates the face plate 42 counterclockwise (when looking at the exterior of the face plate) which causes the nozzle 40 to move axially away from the rotor. Internal rib 64 in bore 46 limits the rotor's axial movement, and permits the nozzle to be spaced from the rotor, as depicted in FIG. 4. In that position, water still flows through the spray head in the same manner as before, causing the rotor the spin. However, the space between the rotor and nozzle provides for a substantially continuous spray from the spray head. Of course, there is an infinite range of positions between the continuous spray position shown in FIG. 4 and the fully pulsating spray position shown in FIG. 3, where the follower only partially engages the cam track.

While the present invention has been described in terms of the preferred embodiment, it is also intended to include those equivalent structures, some of which may be immediately apparent, and others of which may be apparent only after some study of this description.

What is claimed as the invention is:

1. A spray head for generating a pulsating spray, comprising:

a housing;

means defining a flow path in said housing, one end of said flow path being adapted for attachment to a water supply and the other end of said flow path terminating in a spray discharge opening;

a rotor freely rotatably mounted within said housing, said rotor including means to cause rotation of said rotor as water flows through the flow path;

means cooperatively associated with said rotor to cause axial reciprocation of said rotor as it rotates; and means associated with said rotor and disposed relative to said flow path to alternately open and restrict said flowpath as said rotor axially reciprocates, whereby reciprocation of said rotor causes the flow of water through said flow path and the spray emitted therefrom to pulsate.

2. A spray head in accordance with claim 1 wherein said means for causing axial reciprocation comprises a cam track and a cam follower disposed to follow said track, one of said cam track and cam follower being provided on said rotor and the other of said cam track and cam follower being carried by said housing.

3. A spray head in accordance with claim 2 further comprising means for moving selected of said cam follower and said cam track between a first position in which said cam follower and said cam track are in contact for causing axial reciprocation of said rotor and a pulsating spray, and a second position in which said track and follower are displaced from one another and free of substantial contact so as not to cause axial reciprocation of said rotor and thus permit a substantially uniform spray.

4. A spray head in accordance with claim 1 wherein said flow path includes a spray nozzle including means defining an inlet orifice and means for moving said inlet orifice between a position in close proximity to said rotor, whereby reciprocal movement of said rotor alternately opens and restricts said orifice, and a position distal from said rotor, whereby said orifice is substantially continuously open for a continuous spray.

5. A spray head in accordance with claim 4 wherein said means for causing axial reciprocation of said rotor includes a cam track and a cam follower cooperatively engageable with said track, one of said cam track and follower being carried by said rotor, and the other of said cam track and follower being carried by said nozzle.

6. A spray head in accordance with claim 5 wherein said cam track is defined on said nozzle and comprises a generally circular path of varying elevation circumscribing said inlet orifice, said follower being defined by said rotor to engage said cam track when said nozzle is positioned in close proximity to said rotor.

7. A spray head in accordance with claim 4 wherein said nozzle is threadedly engaged with said housing whereby axial movement of said nozzle is achieved by rotation of said nozzle.

8. A spray head in accordance with claim 7 further comprising a spray selection member accessible from the exterior of said spray head and angularly fixed to said nozzle whereby rotation of said selection member causes rotation and axial displacement of nozzle to select the desired spray.

9. A spray head in accordance with claim 1 further comprising means defining a chamber in said flow path, said rotor being located within said chamber and rotatably and axially movable therewithin, water inlet passageways disposed to allow water flow into said chamber in a swirling action, and said rotor including a plurality of vanes to cause rotation of said rotor by said swirling water.

10. A spray head in accordance with claim 9 further comprising means defining an outlet opening in said chamber generally axially aligned with said rotor, whereby the reciprocal movement of said rotor alternately opens and restricts said outlet opening means.

11. A spray head in accordance with claim 10 wherein said means defining said outlet opening is axially movable toward and away from said rotor to provide an infinite variation in the spray condition exiting said spray head.

12. A spray head in accordance with claim 11 wherein said means for causing axial reciprocation of said rotor comprises a cam track of varying elevation and a follower, one of said cam track and follower being carried by said means defining the outlet opening, and the other of said cam track and follower being carried by rotor, said follower and cam track being disposed to cooperate when in engagement to cause axially reciprocal movement of said rotor as it rotates.

13. A spray head for generating a pulsating spray, comprising:

a housing:

means defining a flow path in said housing, one end of said housing being adapted for attachment to a water supply and the other end terminating in a spray discharge opening;

means defining a chamber within said flow path, said chamber having at least one inlet passageway and a single outlet aperture, said inlet passageway being disposed to direct flow into said chamber in a swirling, vortex generating action, said outlet aperture communicating directly with a diverging spray nozzle for providing a substantially uniform spray pattern;

a rotor freely rotatably mounted within said chamber coaxial with said outlet aperture, said rotor including a plurality of vanes for rotating said rotor when engaged by the swirling water; and a surface defined on said rotor adjacent said outlet aperture, said surface being disposed to define an open angle between said surface and the plane of said outlet aperture to allow flow through said outlet aperture when said rotor is in one position and to closely overlie said outlet aperture to restrict flow therethrough when said rotor is in another position, whereby the entire spray emitted from said nozzle is caused to pulsate as said rotor rotates.

14. A spray head in accordance with claim 13 further comprising means for causing axial reciprocation of said rotor toward and away from said outlet aperture as said rotor rotates.

15. A spray head in accordance with claim 13 wherein aid means defining said single outlet aperture is axially movable toward and away from said rotor to adjust the degree of opening and restricting of said outlet aperture.

16. A spray head in accordance with claim 15 wherein said flow path further comprises an axially movable spray nozzle downstream of said chamber, said spray nozzle defining the outlet aperture from said chamber.

17. A spray head in accordance with claim 16 wherein said spray nozzle defines a cam track around said outlet aperture, and said rotor includes a cam follower disposed to engage and follow said track as said rotor rotates and when said spray nozzle is axially located in a position adjacent said rotor, said cam track being shaped to cause axial reciprocation of said rotor as it rotates.

18. A spray head in accordance with claim 16 wherein said nozzle is threadedly engaged with said housing, whereby said nozzle is axially moved by rotating said nozzle.

19. A spray head in accordance with claim 18 further comprising a spray adjustment member rotatably carried by said housing and fixedly attached to said nozzle, said member being accessible from the exterior of said spray head to permit user adjustment of the spray.

20. A spray head for generating a pulsating spray, comprising:

a housing;

means defining a fluid passageway in the housing, one end of said passageway being adapted for attachment to a water supply, the other end terminating in a spray outlet;

said fluid passageway including means defining a chamber having a side wall portion and end walls, a plurality of water inlet passageways in said side wall, said passageways being disposed to direct water into said chamber in a swirling, vortex generating direction;

a spray-forming nozzle carried by said housing downstream of said chamber, said nozzle having an inlet end with an inlet aperture defined therein and an outlet end with an outlet aperture defined therein, said inlet end of said nozzle defining at least a portion of one end wall of said chamber;

a rotor freely rotatably mounted in said chamber, said rotor including vanes disposed to cause rotation of said rotor by said swirling water;

means defining a generally circular cam track on one of said rotor and said inlet end of said nozzle, and means defining a cam follower on the other of said rotor and said inlet end of said nozzle, said cam track being disposed to cause axial reciprocation of said rotor as it rotates; and said rotor including means to alternatively open and restrict said inlet aperture as it axially reciprocates to cause a pulsating flow of water through said inlet operture.

21. A spray head in accordance with claim 20 wherein said nozzle is axially movable between a position in which said cam track and follower engage to provide a pulsating spray and a position in which said cam track and said follower are spaced apart to provide a substantially continuous flow.

* * * * *